US007050728B2

(12) United States Patent
Minagawa et al.

(10) Patent No.: US 7,050,728 B2
(45) Date of Patent: May 23, 2006

(54) DEVELOPER SUPPLY CONTAINER DETACHABLY MOUNTABLE TO IMAGE FORMING APPARATUS DETECTING THE AMOUNT OF DEVELOPER REMAINING IN THE CONTAINER

(75) Inventors: Hironori Minagawa, Moriya (JP); Yutaka Ban, Tokyo (JP); Ayatomo Okino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 10/828,285

(22) Filed: Apr. 21, 2004

(65) Prior Publication Data

US 2004/0247331 A1 Dec. 9, 2004

(30) Foreign Application Priority Data

Apr. 25, 2003 (JP) ..... 2003/121149

(51) Int. Cl.
*G03G 15/08* (2006.01)

(52) U.S. Cl. ..... 399/27; 399/119

(58) Field of Classification Search ..... 399/258, 399/260, 262, 27

See application file for complete search history.

(56) References Cited

U.S. PATENT DOCUMENTS

| | | | | |
|---|---|---|---|---|
| 4,931,838 A | | 6/1990 | Ban et al. | 355/260 |
| 5,574,549 A | * | 11/1996 | Sundquist | 399/262 |
| 5,974,286 A | | 10/1999 | Ban et al. | 399/106 |
| 6,014,536 A | | 1/2000 | Ban et al. | 399/258 |
| 6,016,408 A | | 1/2000 | Hashimoto et al. | 399/27 |
| 6,128,453 A | | 10/2000 | Ban et al. | 399/106 |
| 6,266,505 B1 | | 7/2001 | Ban et al. | 399/258 |
| 6,278,853 B1 | | 8/2001 | Ban et al. | 399/109 |
| 6,336,020 B1 | * | 1/2002 | Ishikawa et al. | 399/227 |
| 2003/0081968 A1 | | 5/2003 | Minagawa | 399/258 |

FOREIGN PATENT DOCUMENTS

| | | |
|---|---|---|
| JP | 10-171232 | 6/1998 |
| JP | 11-38755 | 2/1999 |

* cited by examiner

*Primary Examiner*—Quana Grainger
(74) *Attorney, Agent, or Firm*—Fitzpatrick, Cella, Harper & Scinto

(57) ABSTRACT

A developer supply container detachably mountable to an image forming apparatus includes a container body for containing developer; a discharge opening, disposed at a peripheral surface of the container body, for permitting discharge of the developer therefrom; a feeding device for feeding the developer toward the discharge opening by rotation of the containers body; and a detector for detecting the amount of the developer remaining in the container body. The detector has a detection area which at least partially overlaps the discharge opening as seen in a direction perpendicular to a longitudinal direction of the developer supply container.

9 Claims, 13 Drawing Sheets

| | DEVELOPER AMOUNT |
|---|---|
| | 180g |
| EMB.5 | REST = 3~4g |
| EMB.6 | REST = 6~10g |
| COMP.5 | REST = 20~30g |

DEVELOPER SUPPLY CONTAINER DETACHABLY MOUNTABLE TO IMAGE FORMING APPARATUS DETECTING THE AMOUNT OF DEVELOPER REMAINING IN THE CONTAINER

FIELD OF THE INVENTION AND RELATED ART

The present invention relates to a developer supply container for supplying developer to an image forming apparatus using electrophotography or electrostatic recording, such as a copying machine, a printer or a facsimile machine.

Heretofore, fine powder developer has been used as developer in an image forming apparatus such as an electrophotographic copying machine or a printer. When the developer is consumed, fresh developer is supplied to the image forming apparatus by using a developer supply container.

In such a conventional developer supply container, as means for detecting optically the remaining amount of developer therein, detection means, including two light guide means disposed opposite to each other on a side surface of the developer supply container, has been used (e.g., Japanese Laid-Open Patent Application (JP-A) Hie 10-171232 (pages 1–11, FIGS. 2 and 5)).

Further, it is also possible to use detection means provided with a light reflection or transmission member (toner end detection means) (e.g., JP-A Hei 11-38755 (pages 23 and 24, FIGS. 58 and 60)).

According to these detection means, in the case where there is developer, an optical path is cut off by the developer and when the developer is decreased in amount, a light receiving sensor can detect light.

However, the conventional developer supply containers have been accompanied by the following problems.

In the case of using the detection means as described in JP-A Hei 10-171232, the two light guide means consisting of different members are used, so that the production cost is liable to be increased. Further, in keeping with the current trend, a main assembly of the image forming apparatus is also liable to be compact, so that a developing apparatus per se is also required to be compact. In such a case, the developer supply container is inevitably required to be compact. Accordingly, in some cases, it is impossible to use the two light guide means each disposed on the side surface of the developer supply container as in JP-A Hei 10-171232.

As means for solving such a problem of the placement space of the detection means as in JP-A Hei 10-171232, it is possible to use the toner end detection means as described in JP-A Hei 11-38755.

In the case of a toner cartridge as described in JP-A Hei 11-38755, the toner end detection means is disposed so that it is substantially on an axis line in a rotation axis direction of the toner cartridge together with a toner supply opening of the toner cartridge and that it is closer to a toner receiving opening of a main assembly of the image forming apparatus (i.e., on the near side) than the toner supply opening. As a result, the developer is fed from the far side in the rotation axis direction toward the toner supply port by a feeding member (agitator) provided in the toner cartridge. JP-A Hei 11-38755 describes that the developer always remain only on the near side to the last.

However, in the case where the toner cartridge described in JP-A Hei 11-38755 is mounted in a rotation type developing apparatus, the developer does not necessarily remain in the vicinity of the toner end detection means. Accordingly, there is a possibility that the detection means erroneously detects the absence of developer, although there is still sufficient amount of developer and therefore the toner cartridge containing a large remaining amount of developer is subjected to replacement.

SUMMARY OF THE INVENTION

An object of the present invention is to provide a developer supply container capable of minimizing an amount of developer remaining in the developer supply container.

According to the present invention, there is provided a developer supply container detachably mountable to an image forming apparatus, comprising:

a container body for containing developer, a discharge opening, disposed at a peripheral surface of the container body, for permitting discharge of the developer therefrom, feeding means for feeding the developer toward the discharge opening by rotation of the container body, and detection means for detecting an amount of the developer remaining in the container body, wherein the detection means has a detection area which at least partially overlaps the discharge opening as seen in a direction perpendicular to a longitudinal direction of the developer supply container.

This and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 17(A) and 17(B) are different schematic views of the developer supply container of the present invention.

DETAILED DESCRIPTION OF THE PREFERRED EMBODIMENTS

Hereinbelow, preferred embodiments of the developer supply container according to the present invention will be described with reference to the drawings. In the following description, dimensions, materials, shapes and relative arrangements of structural parts or members are illustrative and may appropriately be modified depending on structures and various conditions of the apparatus to which the developer supply container of the present invention is applicable. Accordingly, it should be understood that the scope of the present invention is not limited to those in the following description unless otherwise specified.

Embodiment 1

Figure 1:
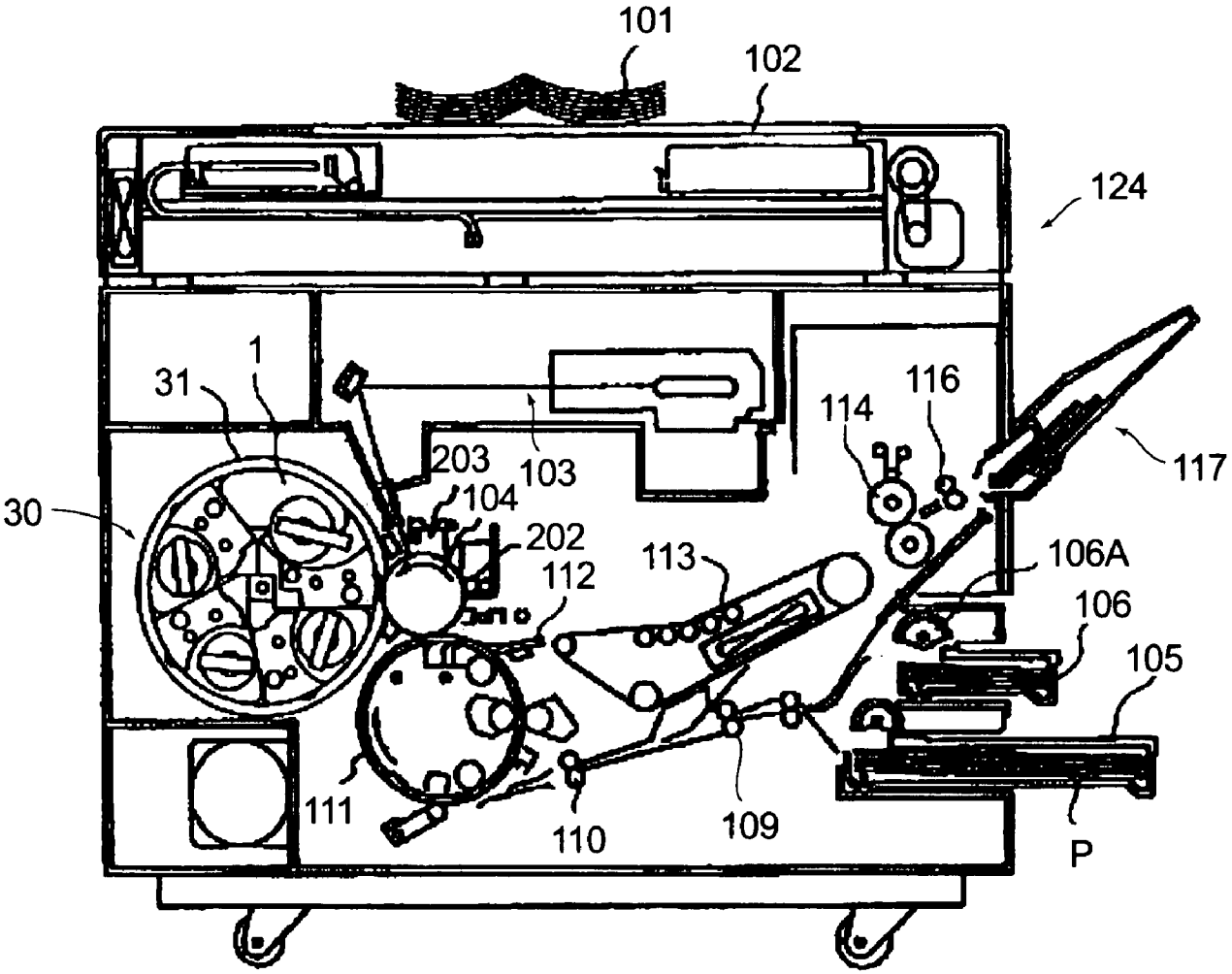
FIG. 1 is a schematic sectional view of an image forming apparatus including the developer supply container according to the present invention.

FIG. 1 is a schematic sectional view showing an embodiment of an image forming apparatus to which the developer supply container according to the present invention is applicable.

First of all, a general structure and operation of the image forming apparatus to which the developer supply container according to this embodiment is detachably mountable will be described.

Referring to FIG. 1, in an image forming portion comprising a photosensitive drum 104, etc., an electrostatic latent image is formed on the photosensitive drum 104 by an optical unit 103 on the basis of image data read from an original 101 set on an original supporting platen glass 102 or image data sent from another piece of equipment. On the other hand, a recording medium P such as sheets of paper, OHP sheets, etc., stacked in paper supply cassettes 105 and 106 is selectively fed by feeding rollers, one of which is denoted as 106A, on the basis of information inputted from an operating unit (not shown) by an operator. A single recording medium P fed from the paper supply cassette is conveyed to registration rollers 110 by way of a feeding portion 109, and is fed to the photosensitive drum 104 by the registration rollers 110 by synchronizing the rotation of the photosensitive drum 104 and the scanning timing of the optical unit 103. A toner image formed on the photosensitive drum 104 by a developing apparatus is transferred onto the recording medium P by transfer means 111. Thereafter, the recording medium P is separated from the photosensitive drum 104 by separation means 112, and is conveyed to a fixing portion 114 by a feeding portion 113. In the fixing portion 114, the toner image on the recording medium P is fixed by heat and pressure. After the fixation, the recording medium P is discharged to a sheet discharge tray 117 by sheet discharging rollers 116.

In the image forming apparatus having the above described structure, around the photosensitive drum 104, a rotation member (rotation type developing apparatus) 30 including four developing devices, cleaning means 202, and primary charging means 203 are disposed. Each of the developing devices in the rotation member 30 develops an electrostatic latent image formed on the photosensitive drum 104 with a toner at a position opposite to the photosensitive drum 104. A developer supply container 1 for supplying toner to each developing device is detachably mounted in a main assembly 31 of the rotation type developing apparatus 30 which is disposed rotatably in a main assembly 124 of the image forming apparatus.

Incidentally, each developing device has a developing roller disposed opposite to the photosensitive drum 104 with a minute spacing (e.g., about 300 μm) (not shown). At the time of development, a thin toner layer is formed on a peripheral surface of the developing roller by a developing blade, and a developing bias voltage is applied to the developing roller to develop the electrostatic latent image formed on the photosensitive drum 104. The charging means 203 is used for electrically charging the photosensitive drum 104, and the cleaning means 202 is used for removing residual toner remaining on the photosensitive drum 104. Developer is reduced in amount by the development, so that developer is successively replenished from the developer supply container 1.

(Structure of Developer Supply Container)

Figure 2:
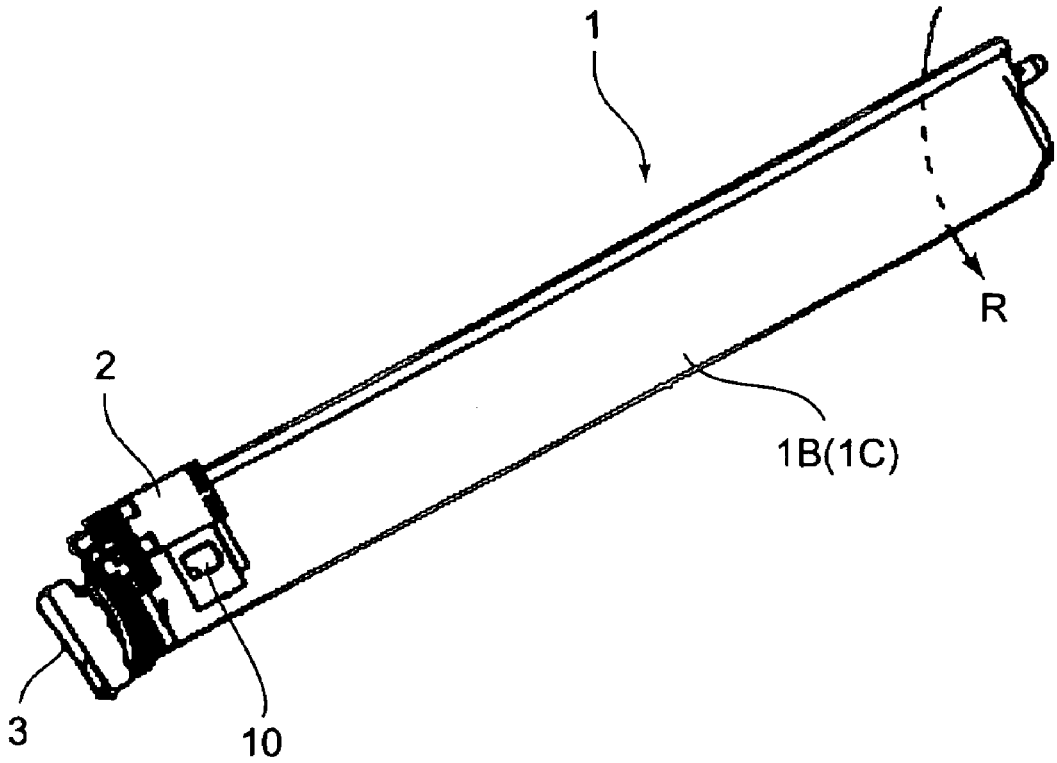
FIGS. 2 and 3 are different perspective views of the developer supply container of the present invention.
Figure 3:
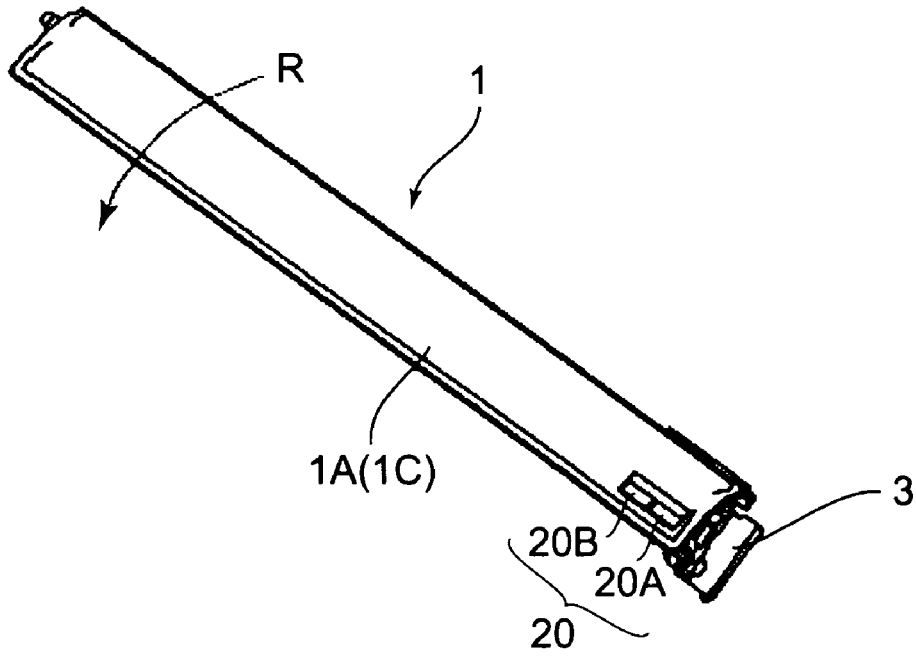
Figure 4:
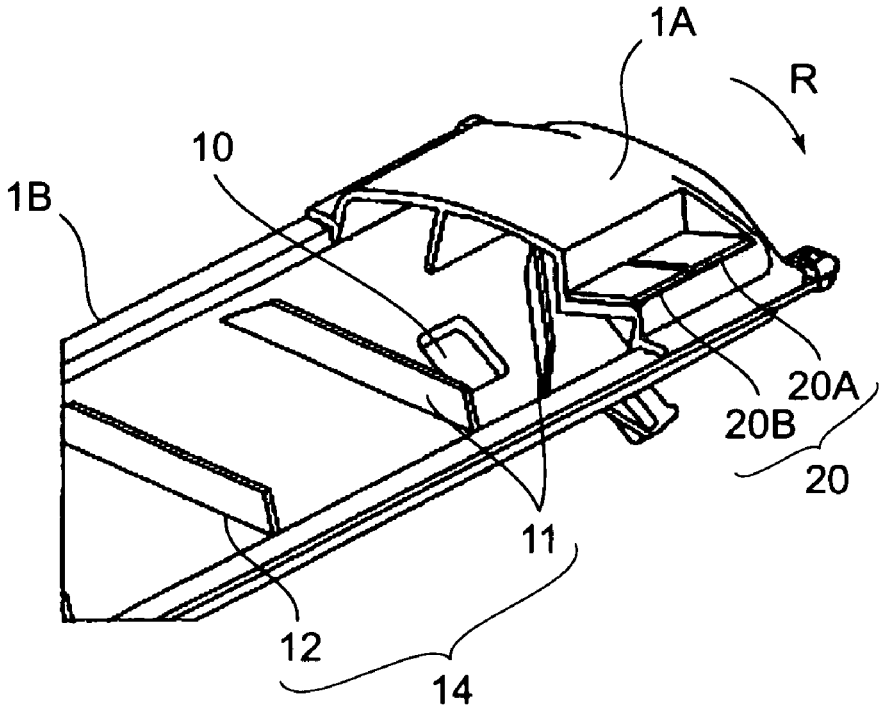
FIG. 4 is a partial perspective view of the inside of the developer supply container.
Figure 5:
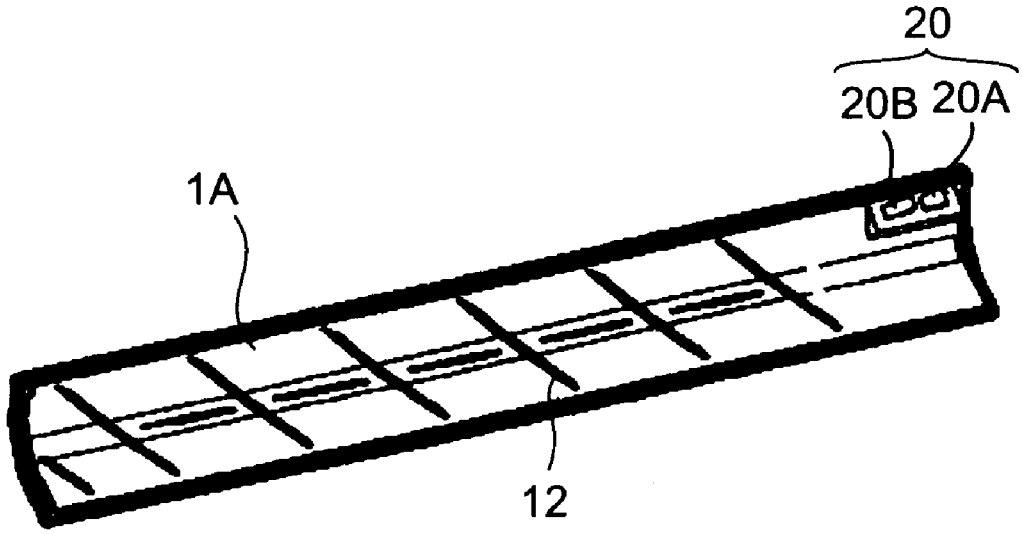
FIG. 5 is a perspective view showing an upper portion of the developer supply container.
Figure 6:
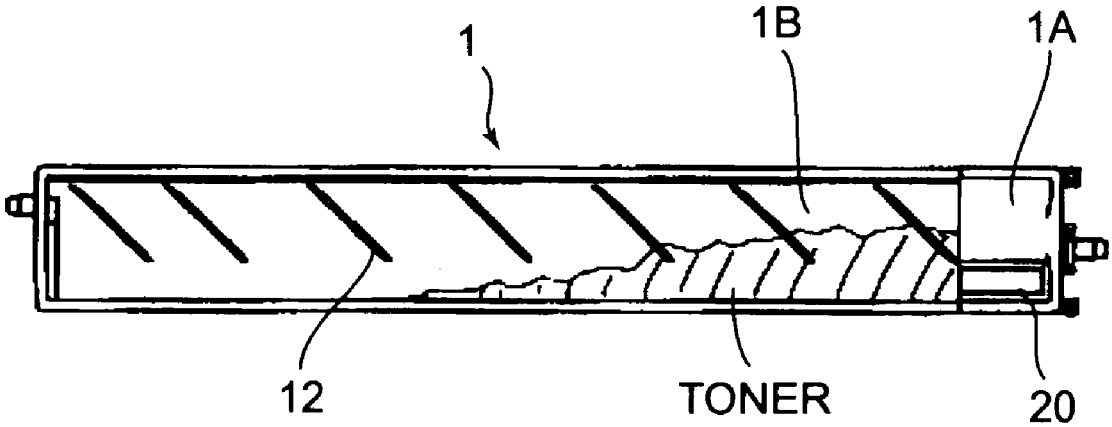
FIG. 6 is a schematic view illustrating a developer state in which less developer is present than when the container is full.
Figure 7:
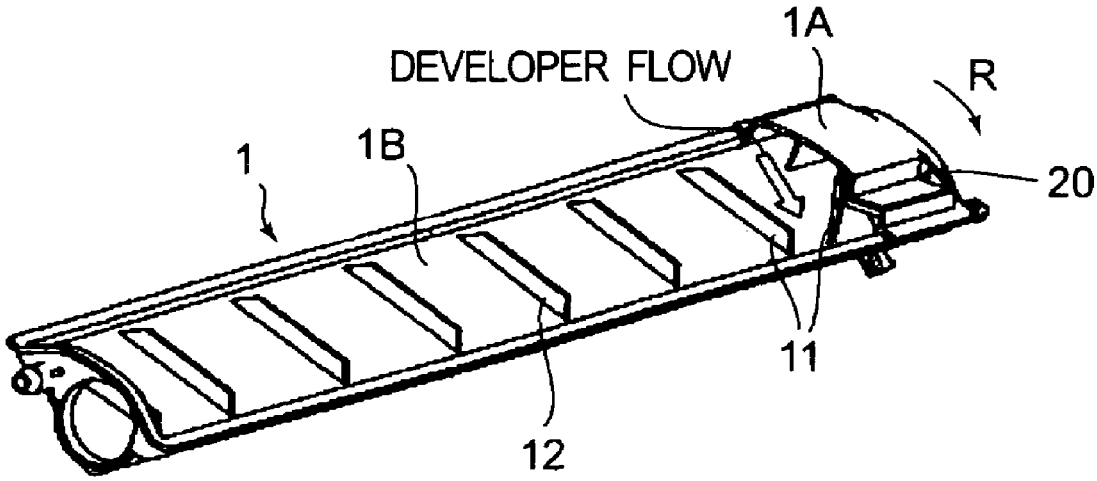
FIGS. 7 and 8 are different perspective views illustrating a flow of developer in the vicinity of discharge opening of the developer supply container.
Figure 8:
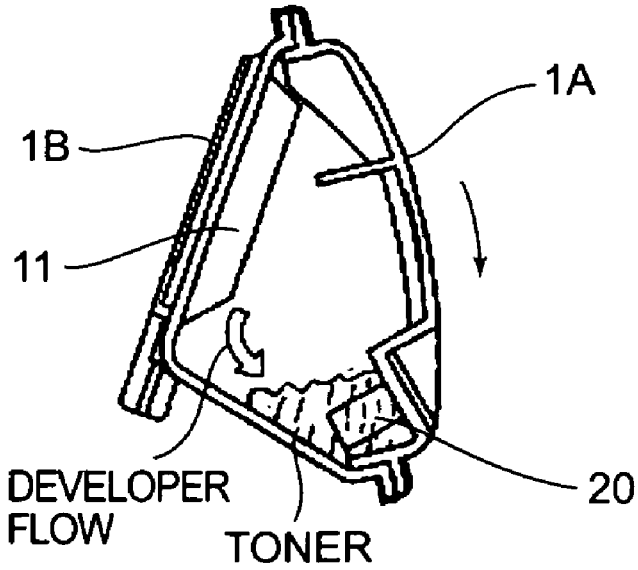
Figure 12:
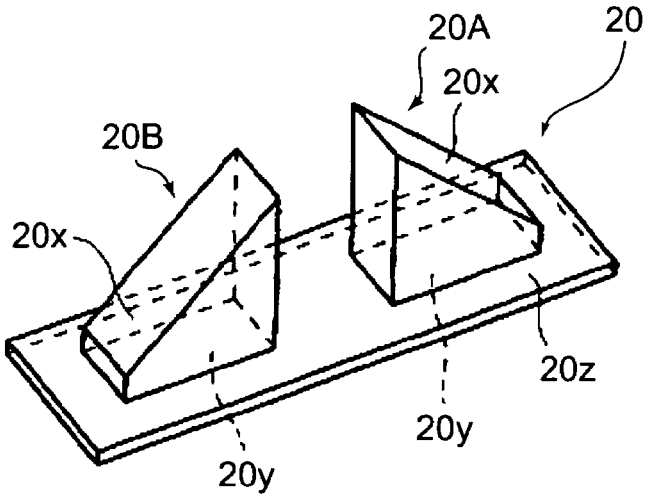
FIGS. 12 and 13 are different perspective views showing light guide means used in the developer supply container of the present invention.
Figure 13:
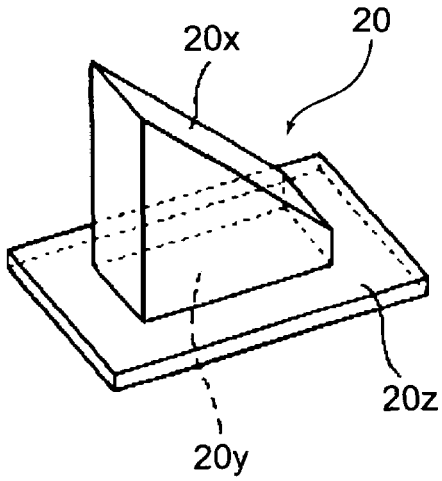

The developer supply container used in this embodiment will be described with reference to the drawings. FIGS. 2 and 3 are perspective views of the developer supply container used in this embodiment, and FIGS. 4 and 5 are perspective views each showing the inside of the developer supply container. FIG. 6 is a view illustrating a state of a diminished amount of developer in the developer supply container. FIGS. 7 and 8 illustrate the flow of developer in the vicinity of a discharge opening of the developer supply container. FIGS. 12 and 13 illustrate light guide means (members) 20.

The developer supply container 1 used in this embodiment is a developer supply container which feeds and discharges developer by the rotation of the rotation member 30, and includes an upper container portion 1A and a lower container portion 1B, more specifically a cylindrical container body 1C for containing developer, a shutter 2 and a knob 3. At a peripheral surface of the container body 1C (the lower container portion 1B), a discharge opening 10 for permitting discharge of the developer therefrom is provided. In this embodiment, the discharge opening is disposed close to one end of the container body 1C in its rotation axis direction as shown in FIG. 2.

Further, at an inner surface of the developer supply container 1, feeding means 14 for feeding the developer in the container body 1C and discharging the developer from the discharge opening 10. At an inner surface of the container body 1C (the lower container portion 1B), the feeding means 14 has feeding projections 12 for stirring and feeding the developer in the container body 1C (the lower container portion 1B) toward the discharge opening 10 and a pair of plate-like projections 11 disposed as a pair of guide means so that they are closer to each other toward the downstream direction with respect to movement of the developer. The pair of plate-like projections 11 are disposed at an inner peripheral surface of the container body 1C (the lower container portion 1B) so as to be opposite to each other through the discharge opening 10, i.e., so as to interpose the discharge opening 10 therebetween, in a longitudinal direction of the developer supply container.

In the vicinity of an area in which the developer is guided and collected by the pair of the pair of plate-like projections 11, light guide means (member) 20 as a detection member (light transmissive member) for detecting a remaining amount of developer is provided. The light guide means 20 includes a first light guide means (member) 20A for permitting transmission or reflection of light emitted from a light emitting element 40 disposed on the main assembly side of the image forming apparatus to which the developer supply container 1 is detachably mounted and a second light guide means (member) 20B for permitting transmission or reflection of light which has passed through the inside of the container body 1C via the first light guide means 20A so as to guide the light to a light receiving element 41 disposed on the main assembly side of the image forming apparatus. In this embodiment, the first and second light guide means (members) 20A and 20B constituting the light guide means 20 are adhered or melt-bonded to the upper container portion 1A side constituting the container body 1C.

These light guide means 20A and 20B are disposed in an area and position to which the developer is guided after passing through the discharge opening 10 by the rotation (revolution) of the container. The light guide means 20 is disposed in the vicinity of the discharge opening 10 in a rotation axis direction of the container as shown in FIG. 4.

The light guide means 20 is a light transmissive member principally formed of a resin (e.g., acrylic resin, polystyrene, polycarbonate, etc.). Further, the light guide means 20 is provided with, as shown in FIG. 13, an inclined surface 20*x*, which is inclined with respect to a mounting surface 20*z*, for reflecting light and a vertical surface 20*y* which is substantially perpendicular to the mounting surface 20*z*, for permitting light transmission. The first and second light guide means 20A and 20B are disposed opposite to each other in the rotation axis direction of the container at the inner surface of the container body 1C (the upper container portion 1A).

In this embodiment, such a structure that the conveyance (feeding) projections 12 as the conveyance (feeding) member for feeding the developer by the rotation are provided in the upper and lower container portions 1A and 1B is exemplified but in the present invention, a structure for feeding the developer to the discharge opening 10 and remaining amount detection portion 20C (detection area) is not limited thereto.

Figure 14:
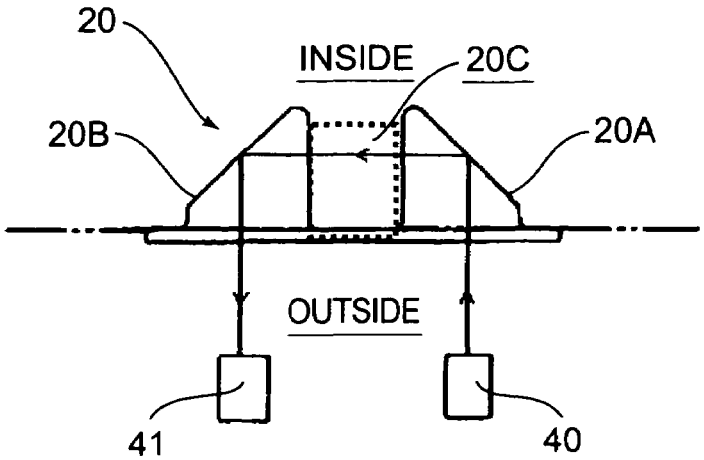
FIG. 14 is a schematic view illustrating a detection method of detecting a remaining amount of developer.

FIG. 14 simply illustrates a mechanism for detecting the remaining amount of developer. Light emitted from the light-emitting element 40 disposed on the image forming apparatus main assembly side passes through the first light guide means 20A and moves toward the second light guide means 20B. At that time, in the case where the developer is present in an optical (light) path between the first and second light guide means 20A and 20B, the light receiving portion (element) 41 disposed on the image forming apparatus main assembly side cannot detect the light since the light is blocked by the developer. On the other hand, in such a state that the developer is substantially absent in the optical path between the first and second light guide means 20A and 20B, the light is not blocked in the optical path, so that the light passed through the first light guide means 20A can reach and pass through the second light guide means 20B. As a result, the light receiving portion (element) 41 can detect the light. At the time when the light is detected in the above-described manner, a determination that the developer is substantially absent is made.

As described above, the light guide means as the detection member permits light transmission from the light emitting portion 40 at the time of detection of the remaining amount of developer in the container, thus being not means (member) for actually detecting the developer remaining amount.

In the above described structure, the developer is fed toward the discharge opening 10 side by the feeding projections 12 under the action of rotation of the container and is discharged from the discharge opening 10. The developer in the container is gradually decreased in remaining amount as shown in FIG. 6 while being collected in the vicinity of the discharge opening 10.

In such a state that the remaining amount of the developer becomes small, the developer which has not been discharged from the discharge opening 10 by rotation of the container is collected in the vicinity of the first and second light guide means 20A and 20B by the pair of plate-like projections 11 as shown in FIGS. 7 and 8.

As a result, it is unnecessary to effect detection of the absence of developer until the remaining amount of developer becomes small, i.e., it becomes possible to effect detection of the absence of developer only after the remaining amount of developer becomes small. Accordingly, it is possible to effect detection of the absence of developer in such a state that the developer in the developer supply container is substantially used up, so that it becomes possible to provide a developer supply container 1 that can be used until only a small amount of developer remains.

Incidentally, the detection area 20C of the light guide means may preferably be disposed in such an area in which the developer is collected by the pair of plate-like projections 11 or on the same peripheral surface including the area.

More specifically, in the present invention, the vicinity of the area in which the developer collected by the pair of plate-like projections is the area in which the developer is collected by the pair of plate-like projections or an area on the same peripheral surface including such an area of the inner surface of the container. The position of the detection area 20 can be appropriately selected in the peripheral direction (rotation direction) of the developer supply container from the view point of, e.g., the rotation mode (stop position) of the rotation member 30, so long as it is on the same peripheral surface.

As described above, according to this embodiment, detection of the remaining amount of developer is effected in the vicinity of the area in which the developer is collected by the pair of plate-like projections 11 under rotation of the container, whereby it is possible to inexpensively detect the absence of developer only after the developer is substantially used up in the developer supply container, without causing error detection.

Further, such an effect of washing away the developer attached onto the surfaces of the first and second light guide means 20A and 20B is achieved by flow of the developer fed by the above described pair of plate-like projections 11. As a result, it is possible to eliminate the need for a wiping member and allow remaining amount detection of developer with an inexpensive structure.

The first and second light guide means 20A and 20B are integrally formed, whereby it is also possible to save mounting space and reduce production cost.

Figure 9:
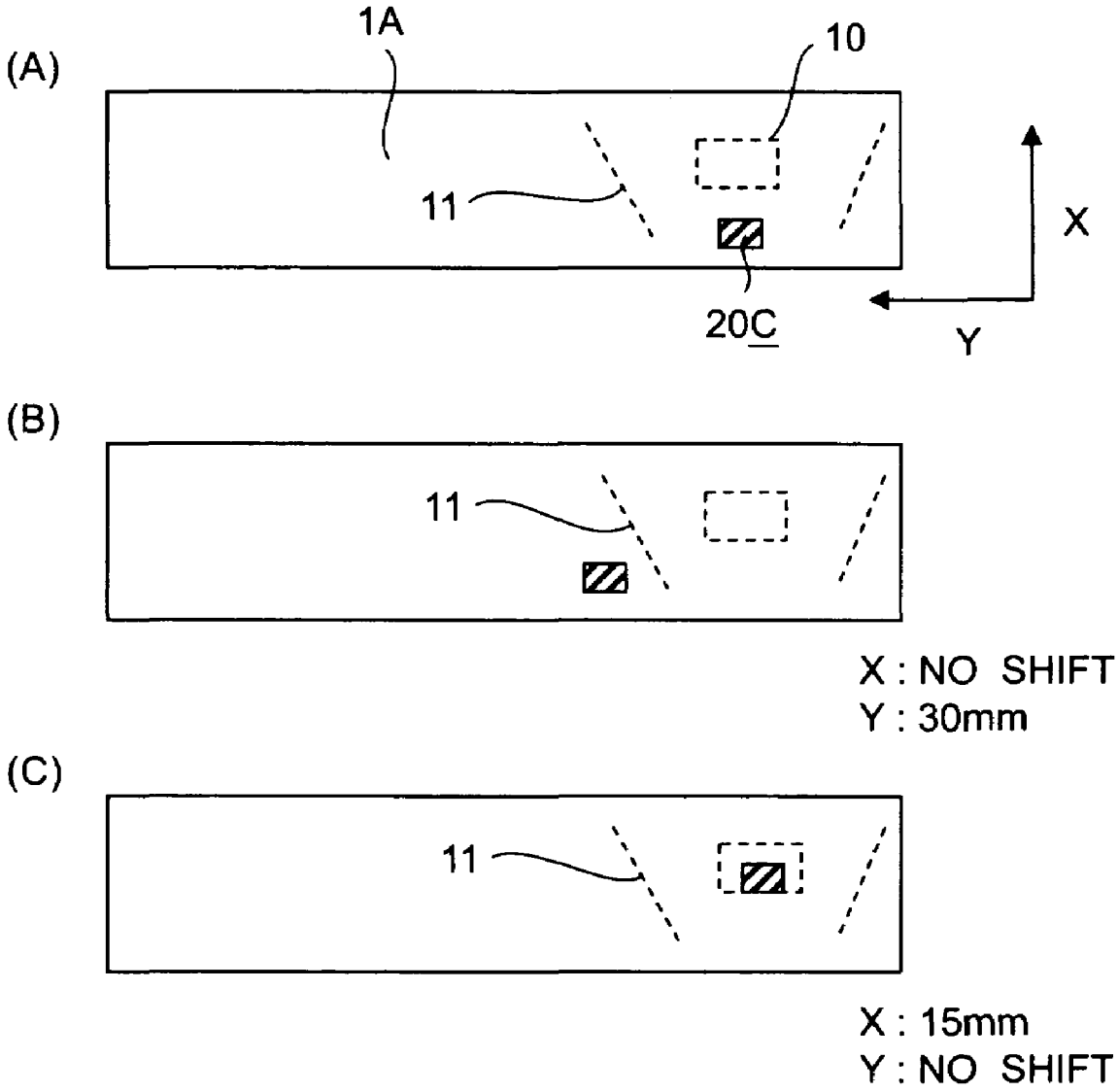
FIGS. 9(A), 9(B) and 9(C) are schematic views each showing the positional relationship between a discharge opening and light guide means in Embodiments 1 to 4 (FIG. 9(A)), Comparative Embodiments 1 to 3 are shown in FIG. 9(B), and Modified Embodiments of the developer supply container are shown in FIGS. 9(A) and 9(C).

Further, at least a part of the detection area 20C of the light guide means 20 overlaps the discharge opening as seen in a direction perpendicular to the longitudinal direction (rotation axis direction) (e.g., as shown in FIG. 9 (A)), so that it is possible to delay remaining amount detection timing for the absence of developer. As a result, an amount of developer remaining in the developer supply container after use can be reduced as small as possible.

Further, as described above, the light guide means 20 is provided with the inclined surface 20*x*, which is inclined with respect to the mounting surface 20*z*, for reflecting light and the vertical surface 20*y* which is substantially perpendicular to the mounting surface 20*z*, for permitting light transmission; and the first and second light guide means 20A and 20B are disposed opposite to each other in the rotation axis direction of the container at the inner surface of the container body 1C (the upper container portion 1(A). As a result, the developer fed by the pair of plate-like projections 11 toward an upstream side in the container rotation direction is liable to flow between the first and second light guide means 20A and 20B, thus being further improved in detection accuracy.

Comparative Embodiment 1

In this comparative embodiment. measurement of the remaining amount of developer at the time of effecting detection of the absence of developer was performed by using a comparative developer supply container shown in FIG. 9(B), as a comparative embodiment for the above described developer supply container (FIG. 9(A)) of Embodiment 1. The (initial) amount of developer to be used is 180 g for the comparative developer supply container and a measurement result is shown in FIG. 15.

In the comparative developer supply container shown in FIG. 9(B), the detection area 20C of the light guide means 20 is shifted in a direction of an arrow Y by 30 mm from a corresponding position of the detection area 20C in the developer supply container of Embodiment 1 (FIG. 9(A)). As apparent from FIG. 9(B), the detection area 20C does not overlap the discharge opening 10 as seen in the direction perpendicular to the longitudinal direction of the comparative developer supply container.

Figure 15:
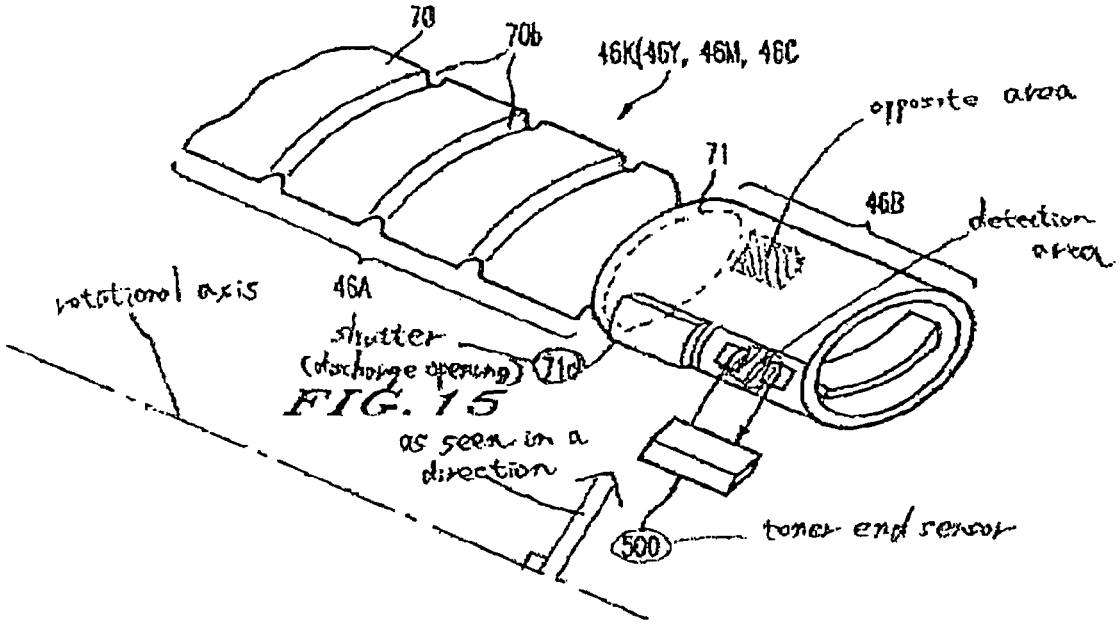
FIG. 15 is a table showing data of the remaining amount of developer in Embodiments 1 to 4 and Comparative Embodiments 1 to 3.

As shown in FIG. 15, a remaining amount of developer at the time of detection of the absence of developer was about 70–80 g (COMP. 1-1).

Incidentally, FIG. 9(C) shows a modified developer supply container as Modified Embodiment 1 for Embodiment 1, wherein the detection area 20C of the light guide means 20 is shifted in a direction of an arrow X by 15 mm from a corresponding position of the detection area 20C in the developer supply container of Embodiment 1.

As shown in FIG. 9(C), the light guide means 20 is located in the upper container portion, not in the lower container portion as in Embodiment 1 (FIG. 9(A), so that a developer remaining amount at the time of detection of absence of developer was about 30–40 g (EMB. 1-2) as shown in FIG. 15. Accordingly, in order to further reduce the developer remaining amount, it is preferable that the light guide means 20 is disposed in the lower container portion of the developer supply container as shown in FIG. 9(A).

Compared with these Comparative and Modified Embodiments 1, a developer remaining amount at the time of detection of the absence of developer in the developer supply container shown in FIG. 9(A) (Embodiment 1) was about 8–10 g (EMB. 1) as shown in FIG. 15.

As is understood from these results (FIG. 15), according to Embodiment 1, the developer is collected close to the light guide means 20 by the pair of plate-like projections 11 with rotation of the container body, so that it is possible to effect detection of no developer with an inexpensive structure and no error detection only after the developer is placed in a state in which the developer is substantially used up. As a result, the developer supply container can be substantially used up.

Embodiment 2

Figure 10:
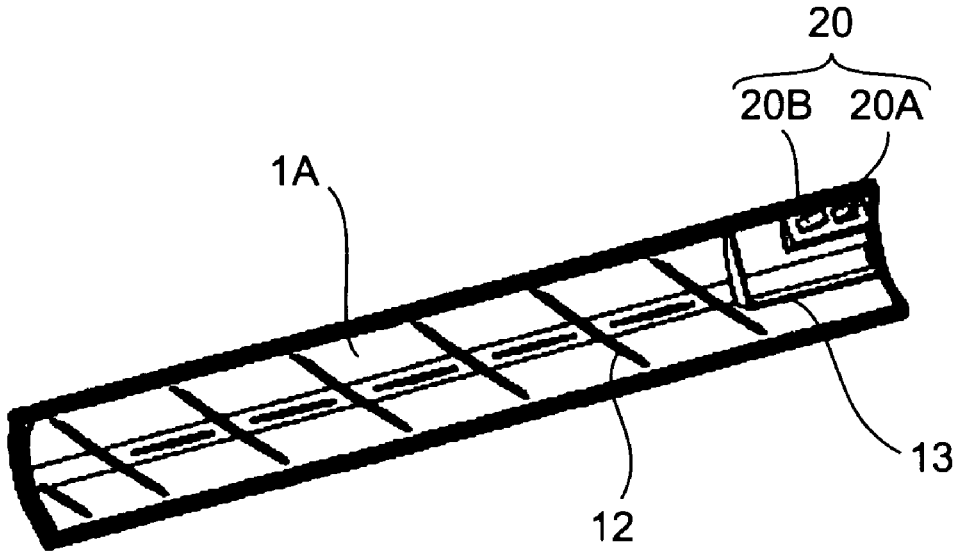
FIG. 10 is a schematic perspective view showing an upper portion of the developer supply container of the present invention.
Figure 11:
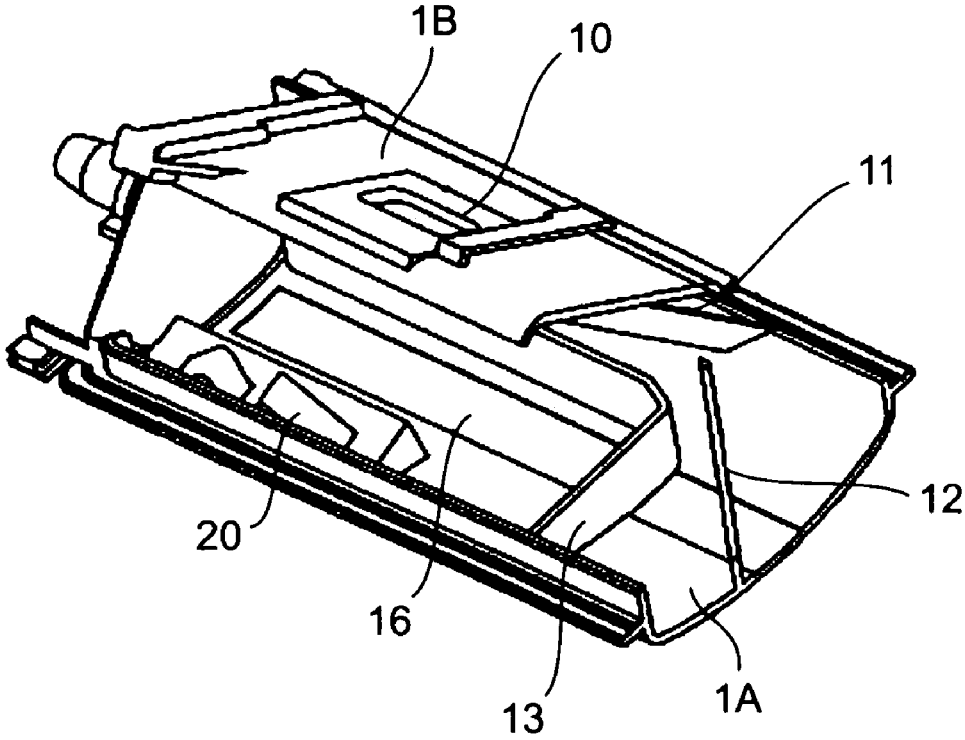
FIG. 11 is a partial perspective view of the developer supply container of the present invention.

A developer supply container according to this embodiment will be described with reference to FIGS. 10 and 11, wherein FIG. 10 is a perspective view showing an upper container portion 1A of the developer supply container and FIG. 11 is a partial perspective view of the developer supply container. In this embodiment, an L-shaped projection 13 is disposed along a rotation direction and a rotation axis direction at an inner wall portion so as to enclose the light guide means (members) 20A and 20B.

The developer fed by the feeding projections (plate-like projections) 11 and 12 after having passed through the discharge opening 10 is more liable to be collected in an area 16 surrounded by the L-shaped charge projection 13. Further, even in the case where the developer, which has been once discharged from the opening 10, is returned into the developer supply container 1 when the discharge opening 10, is directed upward by rotation of the developer supply container 1, it is possible to prevent diffusion of the developer in the developer supply container 1 by the projection 13. Accordingly, detection accuracy is further improved.

According to this embodiment, even in the case where the developer once discharged out of the developer supply container 1 is returned into the developer supply container 1 by rotation, it is possible to prevent diffusion of the developer in the developer supply container 1 by the above-described L-shaped projection 13 as a diffusion suppression member for suppressing diffusion of developer. As a result, the developer remains in the area 16 surrounded by the projection 13, so that detection of the remaining amount of developer by the light guide means 20 placed in such a state that it is surrounded by the projection 13 can be delayed until the amount of developer remaining in the developer supply container 1 becomes smaller. Accordingly, it becomes possible to effect remaining amount detection with high accuracy.

Comparative Embodiment 2

In this comparative embodiment. measurement of remaining amount of developer at the time of effecting detection of absence of developer was performed by using a comparative developer supply container shown in FIG. 9(B) provided with the above-mentioned L-shaped projection 13 (not shown), as a comparative embodiment for the above described developer supply container (FIG. 9(A) of Embodiment 2. The amount of developer to be used is 180 g for the comparative developer supply container and a measurement result is shown in FIG. 15.

As shown in FIG. 15, a remaining amount of developer at the time of detection of absence of developer was about 70–80 g (COMP. 2-1).

Incidentally, FIG. 9(C) shows a modified developer supply container as Modified Embodiment 2 for Embodiment 2, wherein the developer supply container is provided with the L-shaped projection 13 as in the developer supply container of Embodiment 2.

As shown in FIG. 9(C), the light guide means 20 is located in the upper container portion, not in the lower container portion as in Embodiment 2 (FIG. 9(A)), so that a developer remaining amount at the time of detection of absence of developer was about 20–30 g (EMB. 2-2) as shown in FIG. 15. Accordingly, in order to further reduce the developer remaining amount, it is preferable that the light guide means 20 is disposed in the lower container portion of the developer supply container as shown in FIG. 9(A).

Compared with these Comparative and Modified Embodiments 2, the developer remaining amount at the time of detection of the absence of developer in the developer supply container shown in FIG. 9(A) (Embodiment 2) was about 4–6 g (EMB. 2) as shown in FIG. 15.

Compared with these Comparative and Modified Embodiments 2, a developer remaining amount at the time of detection of absence of developer in the developer supply container shown in FIG. 9(A) (Embodiment 2) was about 4–6 g (EMB. 2) as shown in FIG. 15.

Embodiment 3

A developer supply container according to this embodiment will be described with reference to FIG. 12 which shows a light guide means (member) 20 used in this embodiment.

The light guide means shown in FIG. 12 is prepared by integrally forming a first light guide means (member) 20A and a second light guide means (member) 20B and is adhered or melt-bonded to an upper container portion 1A constituting a container body 1C of the developer supply container.

According to this embodiment, it is possible to save mounting space. As a result, it becomes possible to provide a developer supply container which is further reduced in production cost.

Embodiment 4

In this embodiment, as the developer, a two component type developer comprising toner and a carrier. As the carrier, magnetic carrier particles are uniformly mixed in the developer in an amount of 5–3 weight % (specifically, 30 g per 210 g developer in this embodiment).

By mixing the magnetic carrier particles in the developer, it is possible to reduce a degree of attachment of toner to a light transmission window, of the light guide means, which is located at the inside of the developer supply container and contacts the toner. This is because the magnetic carrier particles have a function of scraping the toner attached to the light guide means.

If the mixing amount of the magnetic carrier particles in the developer is smaller than 5 weight %, the above-described toner attachment amount-reducing effect is lowered, and if the mixing amount is larger than 30 weight %, a risk of damaging the light guide means is increased rather than the toner attachment amount-reducing effect. Further, the cost as a kit including the developer supply container and the developer is increased.

Accordingly, as described above, the magnetic carrier particles are uniformly mixed in the developer in the above-described amount, whereby the degree of developer attachment to the light guide means can be reduced and an effect of removing the developer attached to the surface of the light guide means is further improved.

Incidentally, in the case where the light guide means is formed of a resin, a magnetic material dispersion type carrier having a resin-coated surface reduces the possibility of damaging the surface of the light guide means 20 rather than a metal carrier, such as ferrite carrier, since both of the light guide means and the carrier have a resinous surface. As a result, the number of times the developer supply container is used is increased.

Comparative Embodiment 3

In this comparative embodiment, measurement of the remaining amount of developer at the time of effecting detection of the absence of developer was performed by using comparative developer supply containers, shown in FIG. 9(B), each containing the above-described two component type developer used in Embodiment 4, as a comparative embodiment for the above described developer supply containers (FIG. 9(A)) of Embodiments 1 and 2. Further, as a modified embodiment for Embodiments 1 and 2, modified developer supply containers, shown in FIG. 9(C), each containing the two component type developer used in Embodiment 4 are used. The (initial) amount of the two component type developer to be used is 210 g (in which 30 g is the carrier) for each of the developer supply containers and measurement results are shown in FIG. 15.

As shown in FIG. 15, with respect to the developer supply containers having the structure as in Embodiment 1, the remaining amount of two component type developer at the time of detection of the absence of developer was about 80–90 g (COMP. 4-1-1) for the developer supply container shown in FIG. 9(B) and about 35–46 g (EMB. 4-1-2) for the developer supply container shown in FIG. 9(C). On the other hand, the remaining amount of two component type developer at the time of the absence of the developer was about 9–12 g (EMB. 4-1).

Further, with respect to the developer supply containers having the structure as in Embodiment 2, the remaining amount of two component type developer at the time of detection of the absence of developer was about 80–90 g (COMP. 4-2-1) for the developer supply container shown in FIG. 9(B) and about 23–35 g (EMB. 4-2-2) for the developer supply container shown in FIG. 9(C). On the other hand, the remaining amount of two component type developer at the time of the absence of developer was about 5–7 g (EMB. 4-2).

Embodiment 5

Figure 16:
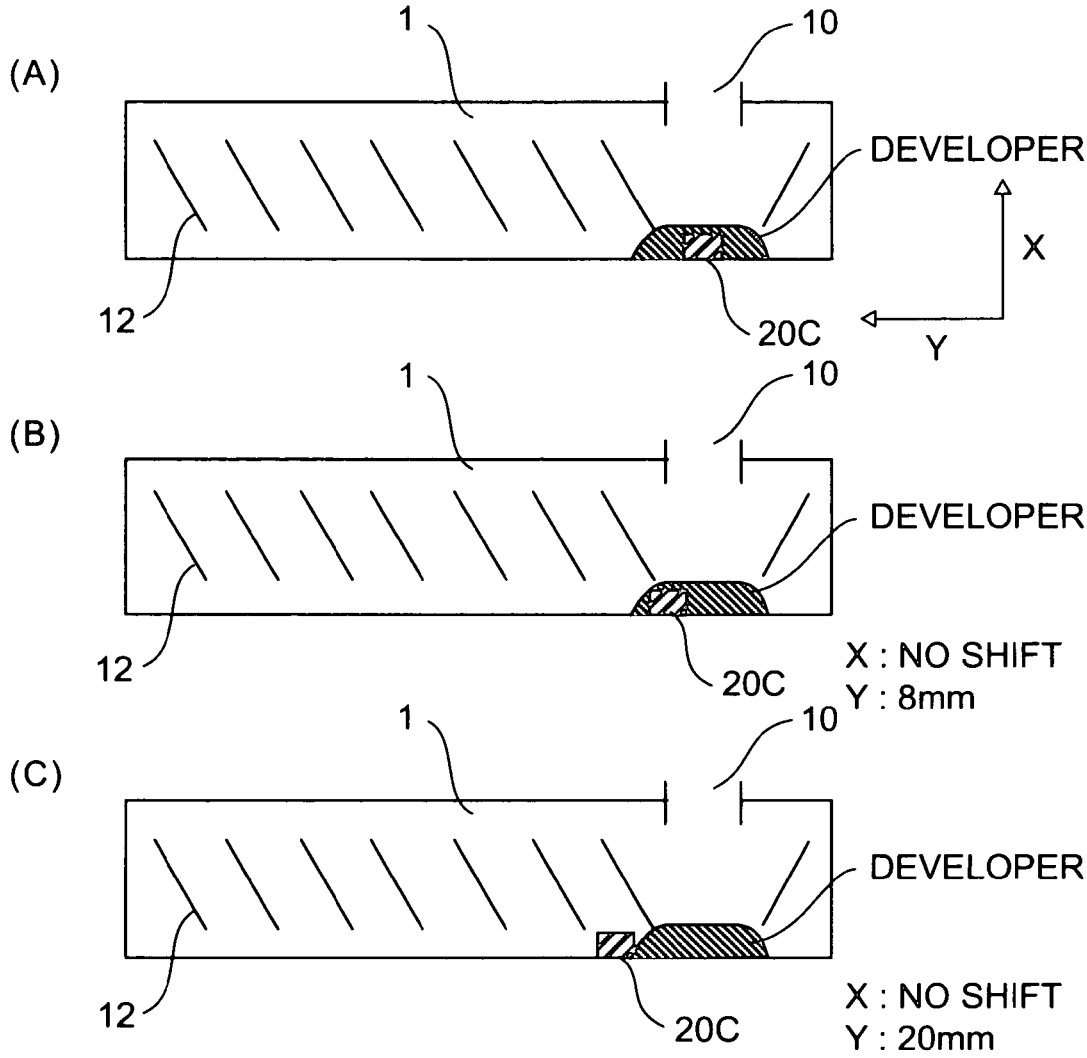
FIGS. 16(*a*), 16(B) and 16(C) are schematic views each showing a positional relationship between the discharge opening and a developer detection area in Embodiment 5 (FIG. 16(A)), Embodiment 6 (FIG. 16(B)), and Comparative Embodiment 5 (FIG. 16(C)).

A developer supply container 1 according to this embodiment will be described with reference to FIGS. 16 and 17.

The developer supply container 1 is a developer supply container of the type wherein the developer is fed and discharged by rotation of a rotation member 30 and a developer receiving container 4 is also rotated together with the developer supply container 1. Other structures of the developer supply container 1 are identical to those of the developer supply container 1 used in Embodiment 1.

In this embodiment as shown in FIG. 16(A), a remaining amount detection area (detection portion) 20C completely overlaps an discharge opening 10 as seen in a direction perpendicular to a longitudinal direction of the developer supply container 1.

In this case, the developer fed by feeding ribs (projections) 12 or the like as a feeding member under rotation of the developer supply container 1 and the developer which has been once discharged from the discharge opening 10 and is returned into the developer supply container 1 are merged with each other. As a result, it becomes possible to effect detection at the time when the remaining amount of developer is very small.

Incidentally, with respect of the mounting position of the light guide means (members) 20A and 20B in a circumferential direction of the developer supply container 1, as shown in FIG. 17(B), the members 20A and 20B may preferably be located in such a position where the developer collected close to the discharge opening 10 by the feeding ribs 12 under rotation of the developer supply container 1 and the developer returned from the developer receiving container 4 into the developer supply container 1 are merged and collected in the detection area 20C. It is preferable that the remaining amount detection is performed at the position.

However, the position of the light guide means 20A and 20B may appropriately be selected between the positions shown in FIGS. 17(A) and 17(B) and in the circumferential direction (rotation direction) of the developer supply container 1 from the viewpoints of structure and space for a developing apparatus, rotation mode (stop position, detection point) of the rotation member, a positional relationship between the remaining amount detection area and the feeding ribs 12, etc.

According to this embodiment, detection of the remaining amount of developer which is returned from the developer receiving container side to the developer supply container side by rotation can be efficiently made, so that it becomes possible to effect the detection at a stage such that the remaining amount of developer in the developer supply container is very small.

Embodiment 6

A developer supply container 1 according to this embodiment will be described with reference to FIGS. 16 and 17.

The developer supply container 1 is a developer supply container of the type wherein the developer is fed and discharged by rotation of a rotation member 30 and a developer receiving container 4 is also rotated together with the developer supply container 1. Other structures of the developer supply container 1 are identical to those of the developer supply container 1 used in Embodiment 1.

In this embodiment as shown in FIG. 16(B), a remaining amount detection area (detection portion) 20C does not completely overlap an discharge opening 10 as seen in a direction perpendicular to a longitudinal direction of the developer supply container 1.

In this case, the developer fed by feeding ribs (projections) 12 or the like as a feeding member under rotation of the developer supply container 1 and the developer which has been once discharged from the discharge opening 10 and is returned into the developer supply container 1 are merged with each other. As a result, it becomes possible to effect detection at the time when the remaining amount of developer is small.

The mounting position of the light guide means (members) 20A and 20B in a circumferential direction of the developer supply container 1 is identical to that in Embodiment 5 described above.

Comparative Embodiment 5

In this comparative embodiment for Embodiments 5 and 6, measurement of remaining amount of developer was performed at the time of detection of the absence of developer by using a comparative developer supply container 1 shown in FIG. 16(C), wherein a remaining amount detection area 20C does not overlap a discharge perpendicular to the opening 10 as seen in a direction perpendicular to the longitudinal direction of the developer supply container 1. The measurement was also performed by using the developer supply containers shown in FIGS. 16(A) and 16(B).

Embodiments 5 and 6

Figures 17, 18:
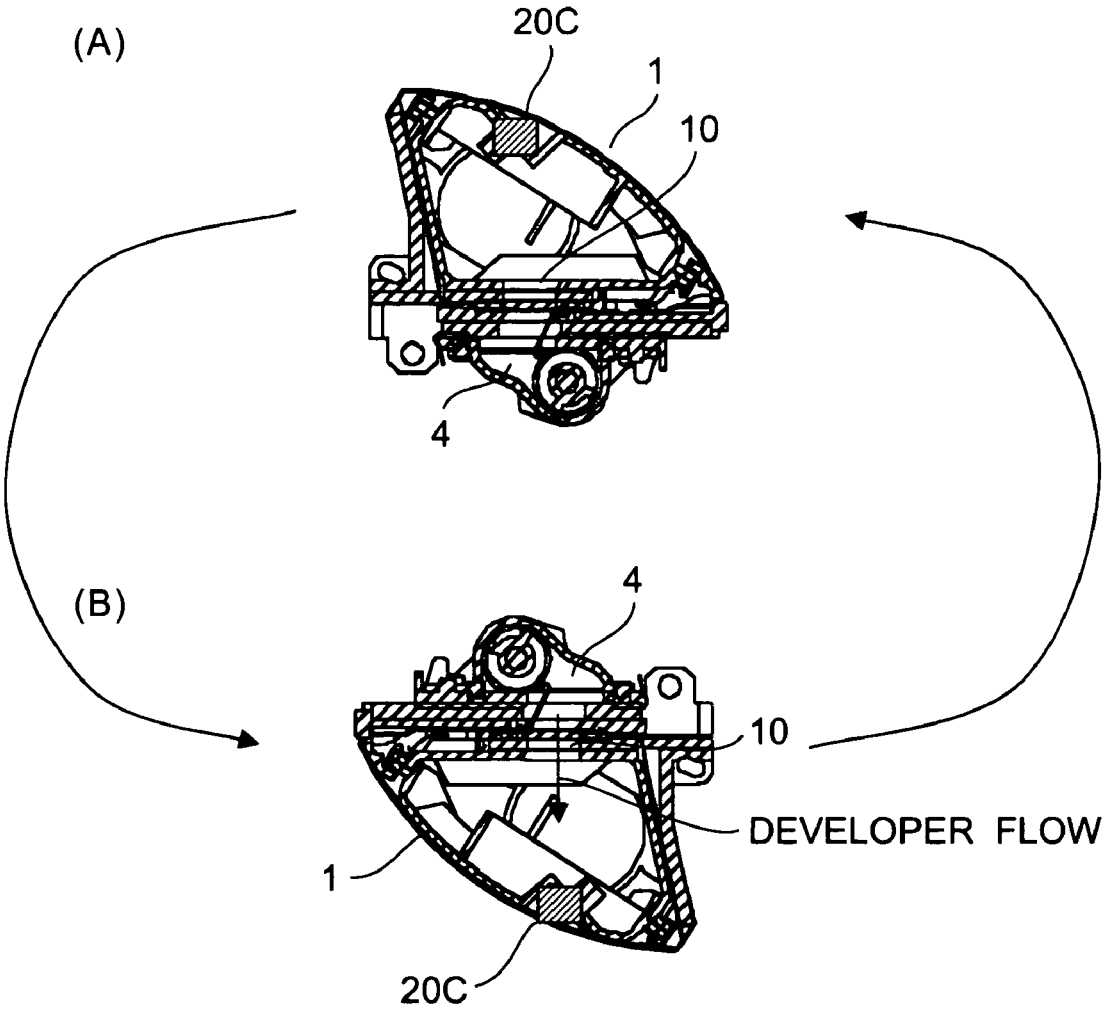
FIG. 18 is a table showing data of the remaining amount of developer in Embodiments 5 and 6 and Comparative Embodiment 5.

The (initial) amount of the developer to be used is 180 g for each of the developer supply containers and measurement results are shown in FIG. 18.

As shown in FIG. 18, the comparative developer supply container shown in FIG. 16(C) had a remaining amount of developer of about 20–30 g (COMP. 5) at the time of detection of the absence of developer.

On the other hand, the remaining amount of developer at the time of detection of the absence of developer was about 3–4 g (EMB. 5) for the developer supply container shown in FIG. 15(A) and about 6–10 g (EMB. 6) for the developer supply container shown in FIG. 16(B).

As is apparent from the above results, according to Embodiments 5 and 6, it is possible to effect detection of the remaining amount of developer including the developer returned from the developer receiving container 4, so that the detection can be effected in such a state that the remaining amount of developer is very small. As a result, it is possible to use up the developer in the developer supply container until a substantially empty state is reached.

Other Embodiments

In the above described embodiments, as the light guide means, a transparent solid light transmissive member is used but it is also possible to use, e.g., a transparent hollow light transmissive member.

Further, in the above-described embodiments, the shape of the container body of the developer supply container of the present invention is substantially circular cylindrical but is not limited thereto. For example, it is also possible to change it into other shapes so long as it is substantially any cylindrical shape for accommodating the developer.

Figure 19:
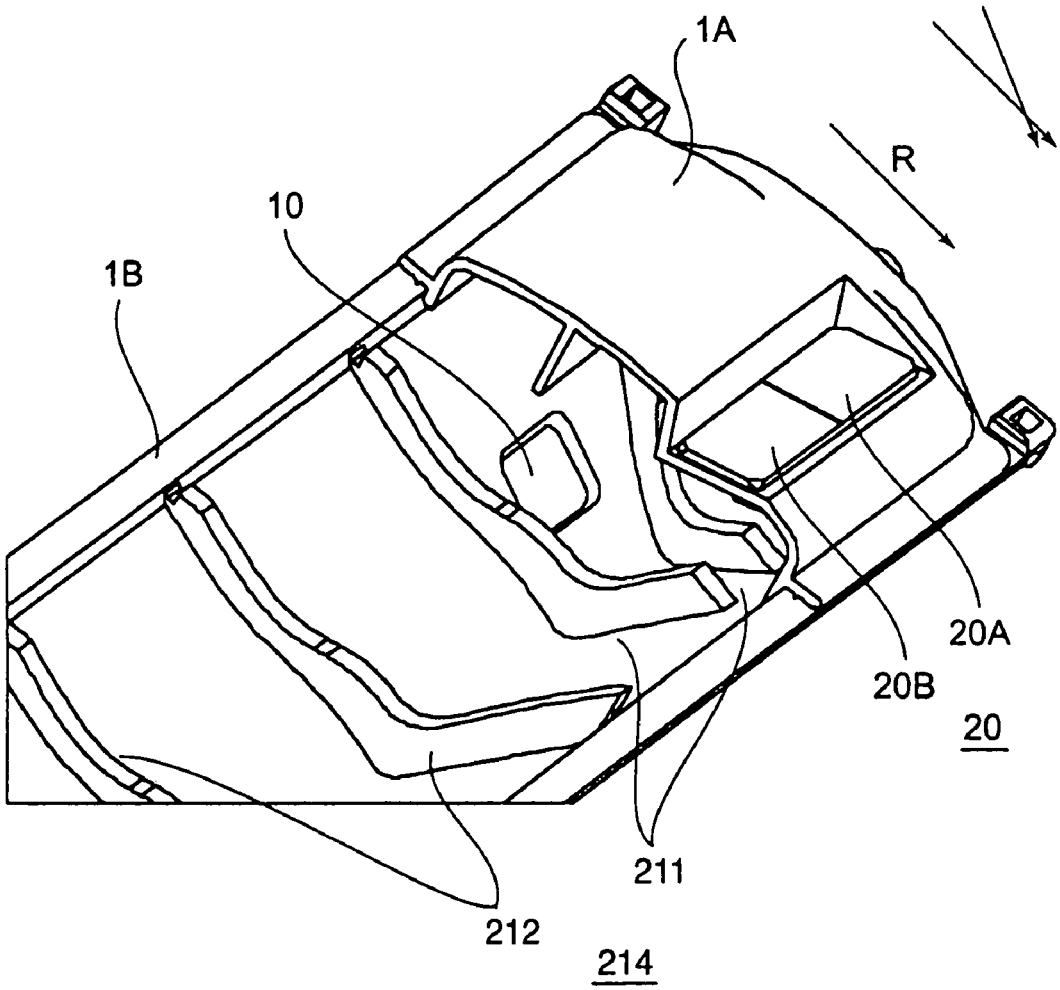
FIGS. 19 and 20 are different partial perspective views of the inside of the developer supply container according to another embodiment of the present invention.
Figure 20:
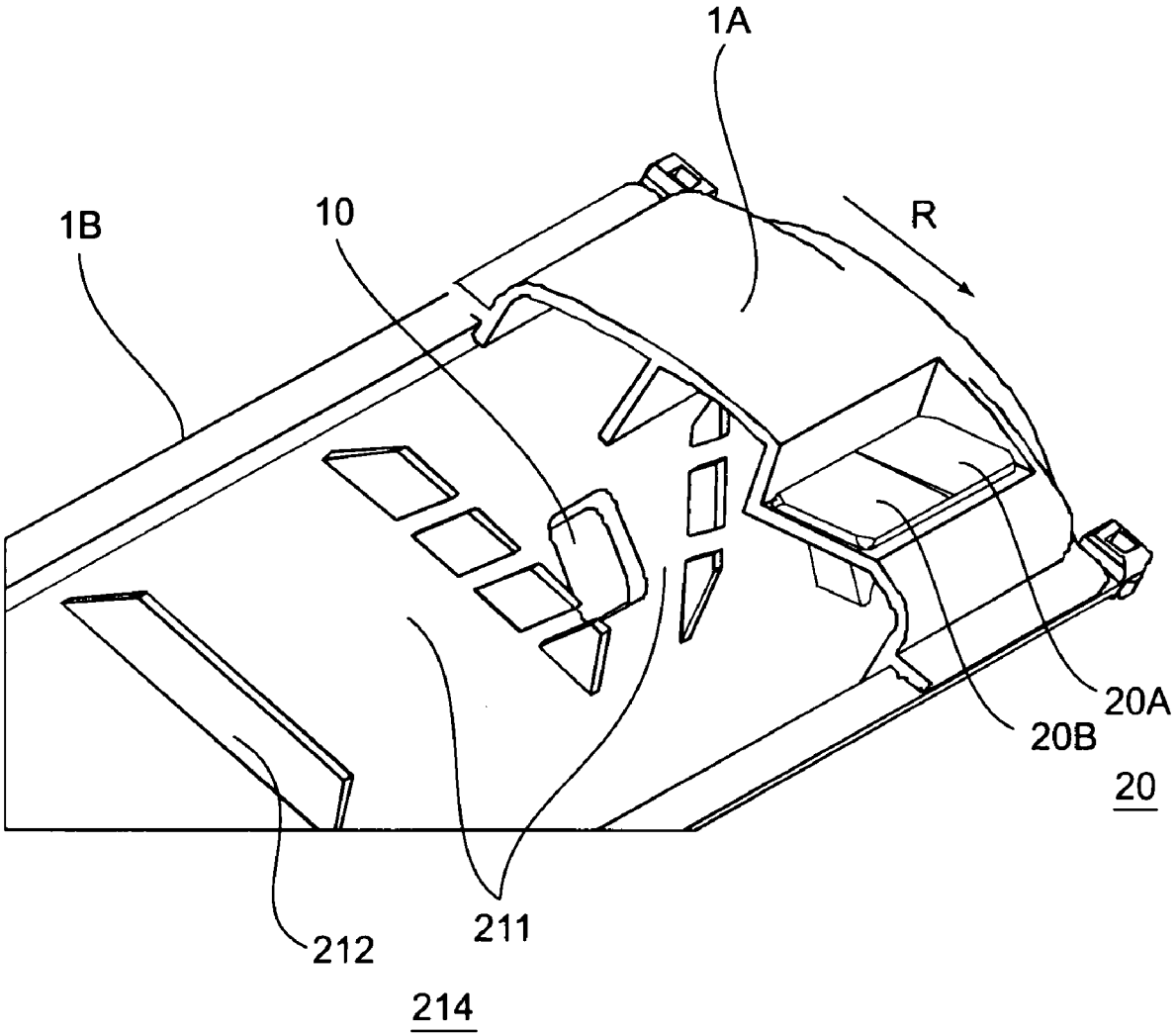

In the above described embodiments, as the feeding means, the feeding projections 12 and the pair of plate-like projections 11 are used but it is possible to use, e.g., feeding means 214 having helical projections 211 and 212 as shown in FIG. 19 showing a modified embodiment of the present invention. As the pair of plate-like projections, it is possible to use a pair of plate-like projections each divided into plural plate-like projections as shown in FIG. 20 showing a modified embodiment. Further, it is also possible to use a single helical recess or projection formed at an inner surface of the developer supply container as a modified example of the feeding means (not shown).

In the above described embodiments, as the image forming apparatus, a copying machine capable of forming monochromatic and full-color images is used but it is also possible to use other image forming apparatuses such as a printer, a facsimile machine, a multiple function processing machine combining these functions, and such an image forming apparatus in which respective color toner images are successively superposed on an intermediary transfer member, such as an intermediary transfer belt or an intermediary transfer drum and are simultaneously transferred onto a transfer material. When the developer supply container of the present invention is mounted in the image forming apparatus, it is possible to achieve the above described effects.

Further, in the present invention, the number of the developing devices is not limited to four as in the above described embodiments but may be one for monochromatic color or two or more for multiple colors or full color. The developer supply container can achieve the same effects as described above also in these cases.

In the present invention, the light guide means is used as the remaining amount detection means but any remaining amount detection means may be essentially applicable. For example, a remaining amount detection means of electrostatic capacity type.

As described hereinabove, according to the present invention, it is possible to properly detect a developer remaining amount, e.g., the absence of developer even in such a state that a remaining amount of developer in the developer supply container is very small. In other words, it is possible to reduce the amount of developer remaining in the developer supply container after being used as small as possible.

What is claimed is:

1. A developer supply container detachably mountable to an image forming apparatus, comprising:

a developer supply container body configured to contain developer;

a discharge opening, disposed at a peripheral surface of said developer supply container body, configured and positioned to permit discharge of the developer therefrom;

a feeding device configured and positioned to feed the developer toward said discharge opening by rotation of said developer supply container body; and a detection member configured and positioned to detect the amount of the developer remaining in said developer supply container body, wherein said detection member has a detection area which at least partially overlaps said discharge opening as seen in a direction perpendicular to a rotational axis of said developer supply container.

2. A container according to claim 1, wherein said developer supply container further comprises:

a pair of guide devices disposed at an inner surface of said developer supply container body and extending toward said discharge opening to be closer to each other in the direction of movement of the developer toward said discharge opening, and wherein the detection area of said detection member is disposed in an area in which the developer is collected by said pair of guide devices.

3. A container according to claim 2, wherein one of said pair of guide devices is disposed so as to guide developer located between said discharge opening and one end of said developer supply container in the direction of the rotational axis of said developer supply container toward said discharge opening, and the other guide device is disposed so as to guide developer located between said discharge opening and the other end of said developer supply container in the rotational axis toward said discharge opening.

4. A container according to claim 1, wherein said detection member comprises a light transmission member configured and positioned to guide light from a light emitting element provided in the image forming apparatus to said detection area and to guide the light from said detection area to a light detecting element provided in the image forming apparatus.

5. A container according to claim 1, wherein the detection area of said detection member partially overlaps said discharge opening as seen in a direction perpendicular to a rotational axis of said developer supply container.

6. A developer supply container which is detachably mountable to an image forming apparatus including a developer receiving container provided with a developer receiving opening and a rotation member, said developer supply container being holdable by the rotation member together with the developer receiving container to permit revolution of said developer supply container, comprising:

a container body configured to contain developer;

a developer discharge opening disposed at a peripheral surface of said container body, configured and positioned to permit discharge of developer therefrom;

a feeding device configured and positioned to feed the developer in said container body toward said developer discharge opening communicating with the developer receiving opening by revolution of said developer supply container; and a detection member configured and positioned to detect the remaining amount of the developer in said container body when said developer discharge opening is directed upward, wherein said detection member has a detection area disposed substantially opposite to said developer discharge opening.

7. A container according to claim 6, wherein said detection member comprises a light transmission member configured and positioned to guide light from a light emitting element provided in the image forming apparatus into said container body and to guide the light from said container body to a light detecting element provided in the image forming apparatus.

8. A container according to claim 1 or 6, wherein said developer comprises toner and a carrier and contains 5–30 weight % of the carrier.

9. A container according to claim 1 or 6, wherein said container further comprises a surrounding member disposed at an inner wall of said container body so as to surround said detection area.

* * * * *

UNITED STATES PATENT AND TRADEMARK OFFICE

CERTIFICATE OF CORRECTION

PATENT NO. : 7,050,728 B2
APPLICATION NO. : 10/828285
DATED : May 23, 2006
INVENTOR(S) : Hironori Minagawa et al.

It is certified that error appears in the above-identified patent and that said Letters Patent is hereby corrected as shown below:

ON THE TITLE PAGE, AT ITEM (30), Foreign Application Priority Data:
"2003/121149" should read --2003-121149--.

ON THE TITLE PAGE, AT ITEM (57), ABSTRACT:
Line 7, "containers" should read --container--.

IN THE DRAWINGS SHEET NO. 9 of 13:
FIG. 15 should read as follows:

| | DEVELOPER AMOUNT | |
|---|---|---|
| | 180g | 210g (INSIDE CARRIER 30g) |
| EMB.1 | REST = 8~10g | |
| COMP.1-1 | REST = 70~80g | |
| EMB.1-2 | REST = 30~40g | |
| EMB.2 | REST = 4~6g | |
| COMP.2-1 | REST = 70~80g | |
| EMB.2-2 | REST = 20~30g | |
| EMB.4-1 | | REST = 9~12g |
| COMP.4-1-1 | | REST = 80~90g |
| EMB.4-1-2 | | REST = 35~46g |
| EMB.4-2 | | REST = 5~7g |
| COMP.4-2-1 | | REST = 80~90g |
| EMB.4-2-2 | | REST = 23~35g |

FIG. 15

UNITED STATES PATENT AND TRADEMARK OFFICE

CERTIFICATE OF CORRECTION

PATENT NO. : 7,050,728 B2
APPLICATION NO. : 10/828285
DATED : May 23, 2006
INVENTOR(S) : Hironori Minagawa et al.

It is certified that error appears in the above-identified patent and that said Letters Patent is hereby corrected as shown below:

COLUMN 7:
Line 11, "portion 1(A)" should read --portion 1(A))--.
Line 20, "embodiment." should read --embodiment,--.

COLUMN 9:
Lines 10-14 should be deleted.

COLUMN 10:
Line 57, "an" should read --a--.

COLUMN 11:
Line 42, "an" should read --a--.

Signed and Sealed this

Twenty-ninth Day of September, 2009

David J. Kappos

David J. Kappos
*Director of the United States Patent and Trademark Office*